US006569027B2

(12) United States Patent
Florian

(10) Patent No.: US 6,569,027 B2
(45) Date of Patent: May 27, 2003

(54) GOLF PUTTING GAME WITH TILT MECHANISM

(76) Inventor: Raymond J. Florian, 14440 Elwell, Belleville, MI (US) 48111

( * ) Notice: Subject to any disclaimer, the term of this patent is extended or adjusted under 35 U.S.C. 154(b) by 0 days.

(21) Appl. No.: 09/769,940

(22) Filed: Jan. 26, 2001

(65) Prior Publication Data

US 2002/0103036 A1 Aug. 1, 2002

(51) Int. Cl.[7] ..... A63B 69/36
(52) U.S. Cl. ..... 473/160; 473/163
(58) Field of Search ..... 473/131, 157–164, 473/166, 181, 182, 184, 191, 194

(56) References Cited

U.S. PATENT DOCUMENTS 1,676,804 A * 7/1928 Scheck ..... 273/125 R
1,862,093 A * 6/1932 Murray ..... 273/123 A
3,275,325 A * 9/1966 MacKenzie ..... 193/2 R
3,424,463 A * 1/1969 Matthews ..... 273/124 R
3,584,877 A 6/1971 Florian ..... 273/176
4,783,075 A * 11/1988 Simjian ..... 473/159
5,042,813 A * 8/1991 Huang ..... 473/153
5,139,262 A * 8/1992 Lai ..... 473/160
5,171,016 A * 12/1992 Kamal ..... 273/DIG. 30
5,390,925 A * 2/1995 Wiltse ..... 473/160
5,516,109 A * 5/1996 Desjardins ..... 473/160
5,725,438 A * 3/1998 Dennesen ..... 473/163
6,338,682 B1 * 1/2002 Torchia et al. ..... 473/160

* cited by examiner

*Primary Examiner*—Mark S. Graham
(74) *Attorney, Agent, or Firm*—Charles W. Chandler

(57) ABSTRACT

A portable putting green for practicing putting which includes an elongate putting mat elevated at one end by an inclined putting structure with a target hole. The putting structure includes an inclined central ramp with the target hole. The angle of inclination and lateral tilt of the putting structure is adjustable using arms pivotally connected to the putting structure which are used to selectively elevate the rear and opposite sides of the putting structure, so as to simulate different holes of a golf course.

14 Claims, 4 Drawing Sheets

GOLF PUTTING GAME WITH TILT MECHANISM

BACKGROUND OF THE INVENTION

1. Field

This invention relates to golf games used for fun and to improve a person's putting skills, and more particularly to portable golf games for improving putting accuracy.

2. State of the Art

My U.S. Pat. No. 3,584,877 discloses a portable Golf Game which comprises a putting mat simulating a golf green, having a putting end and an inclined scoring end. The scoring end includes an incline with an attached vertical stop wall, and a ball-receiving target hole, which is centrally located on the incline. An adjacent secondary scoring area printed on the putting mat includes scoring sub-areas worth various scores less than the target hole. The angle of the incline is such that some of the golf balls putted onto the incline which do not have enough momentum to reach the hole or which are putted off-line, roll off the incline onto the secondary scoring area.

SUMMARY OF THE INVENTION

The invention comprises a portable putting green for practicing putting using a putter, a golf ball, and a novel scoring method. The putting green comprises an elongate putting mat having respective putting and greens portions, with a main target hole in the greens portion to receive the golf ball. The putting green further comprises an inclined putting structure which includes a structure comprising a base, an inclined central ramp supported by the base, and an upstanding peripheral wall which extends around at least a portion of the central ramp to retain the golf ball on the putting structure. The central ramp includes a target hole recess, a downwardly inclined inner ball return channel having an inlet extending from the target hole recess and an outlet adjacent the front edge of one of the sides of the central ramp. A second inner ball-return channel of similar configuration extends from the target hole in the opposite direction another outlet adjacent the front edge of the central ramp.

The greens portion of the putting mat is mounted on the central ramp, with the main target hole located over the target hole recess, such that when the golf ball is struck in such a manner as to pass through the main target hole, the ball rolls into the ball return channel, and out onto the putting mat, with sufficient velocity to roll to a position adjacent the putting end of the mat.

The putting mat preferably includes two secondary target holes in the inclined greens portion. The secondary target holes have a different diameter, size, or shape than the main target hole to provide a different level of putting difficulty, each secondary target hole being disposed above a respective ball return channel. A back wall prevents golf balls from rolling off the rear edge of the central ramp into the outer ball return channel, and includes indicia indicating a scoring value for the main target hole and for each of the secondary target holes.

The back wall preferably is of a generally U-shape which extends completely around the sides and rear of the central ramp to restrain balls from rolling off the sides and rear of the putting structure. A downwardly inclined outer ball return channel is disposed between the central ramp and the back wall.

The degree of putting difficulty of the putting green is adjustable by means of a variable incline mechanism, and a variable lateral tilt mechanism. The incline mechanism supports the rear of the base structure in a raised position to further incline the central ramp.

The variable lateral tilt mechanism alternately supports a selected side of the base structure in a raised position to tilt the central ramp.

The method of simulating full course play on the portable putting green comprises the steps of: 1) placing the golf ball at a position along the putting portion of the putting mat, 2) striking the golf ball with the putter towards the main target hole, and 3) changing at least one of the parameters of the inclined putting structure after a predetermined number of putts to simulate playing different groups of nine or eighteen holes on a golf course.

THE DRAWINGS

The best mode presently contemplated for carrying out the invention is illustrated in the accompanying drawings, in which.

DETAILED DESCRIPTION OF THE PREFERRED EMBODIMENTS

Figure 1:
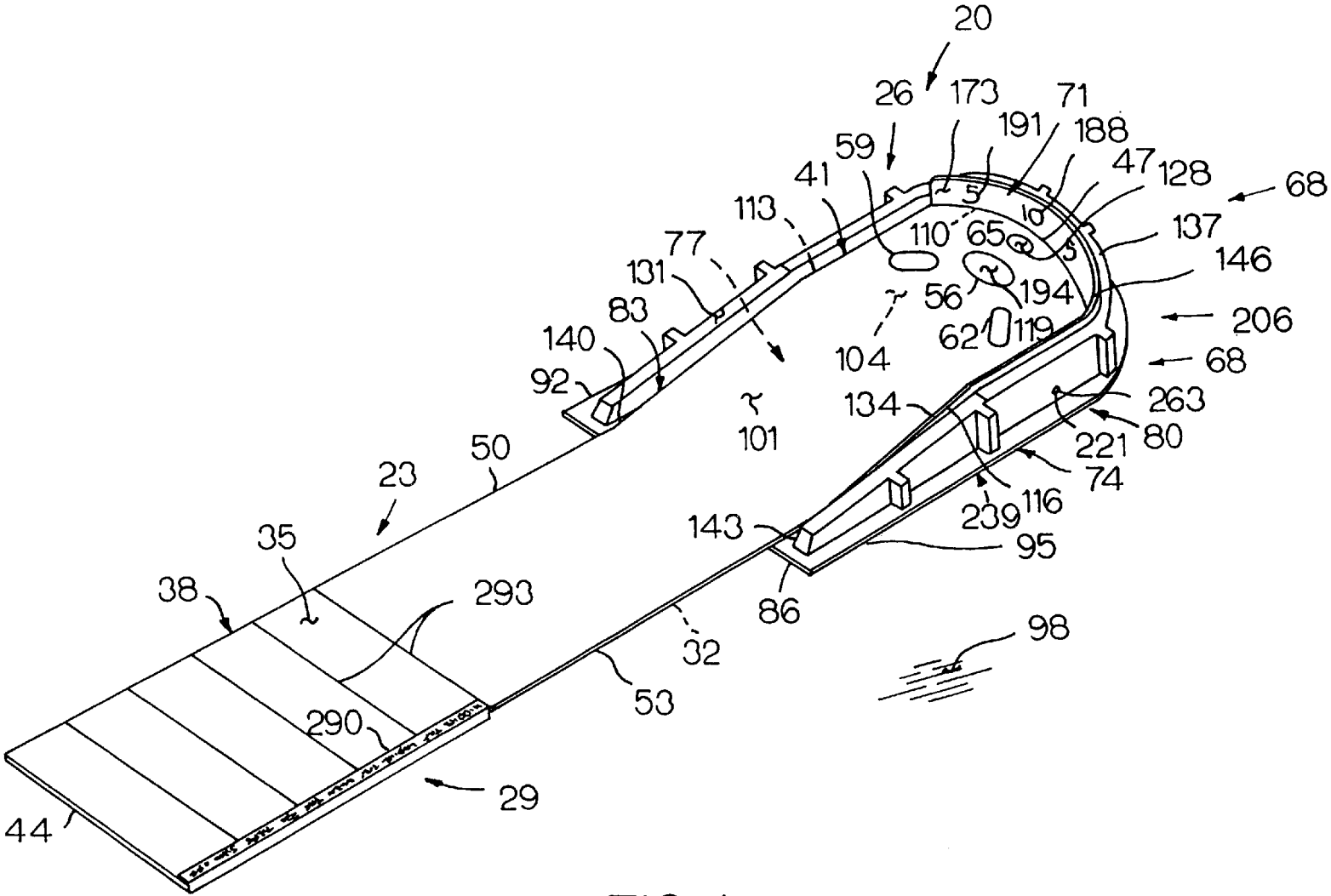
FIG. 1 is a perspective view of a portable putting green illustrating the invention.

FIG. 1 shows a portable putting green 20 of the invention, which comprises an elongate putting mat 23, an inclined putting structure 26, and an elongate stance marker 29.

Putting mat 23 is an artificial turf comprising a lower backing pad or sheet 32 and an upper putting surface 35 comprising a plurality of individual upstanding strands of artificial grass (not shown) interwoven into sheet 32 to simulate the look, feel, and roll of real grass. Putting mat 23 includes a putting portion 38, and a greens portion 41, with a respective straight edge 44 at putting portion 38, an arcuate end edge 47 at greens portion 41, and left and right side edges 50 and 53.

A circular main target hole 56 is centrally located on greens portion 41 adjacent end edge 47, non-circular secondary target holes 59 and 62, and a logo or alignment plug hole 65 behind main target hole 56.

Figure 3:
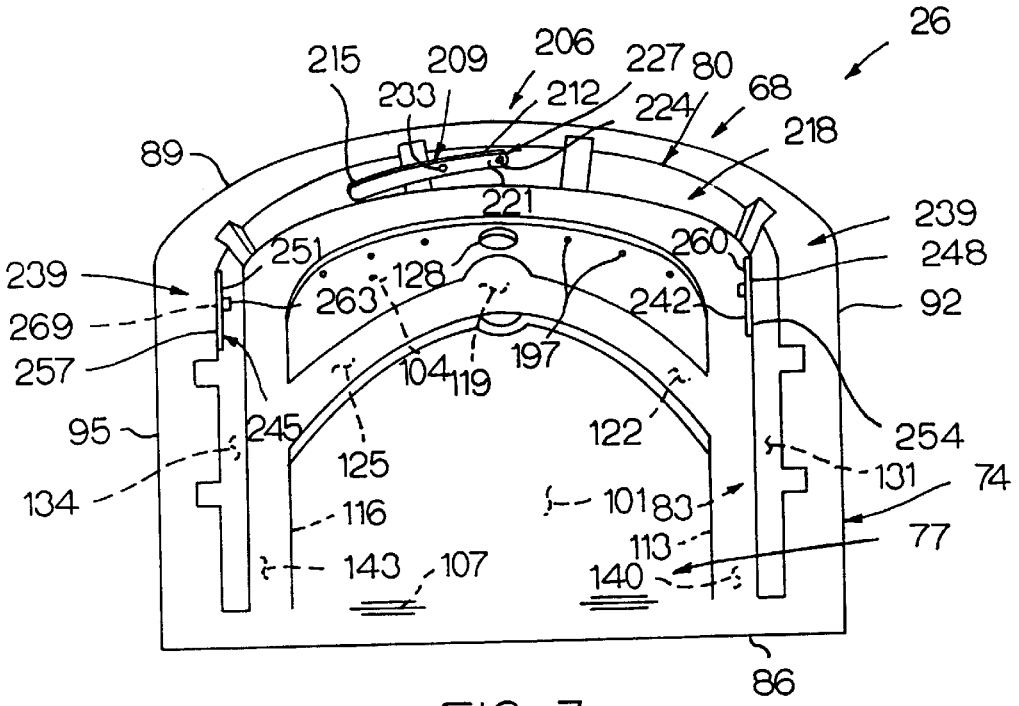
FIG. 3 is a bottom plan view of the inclined putting structure showing the lightweight, hollow construction thereof and the relative positions of the incline and tilt mechanisms.
Figure 2:
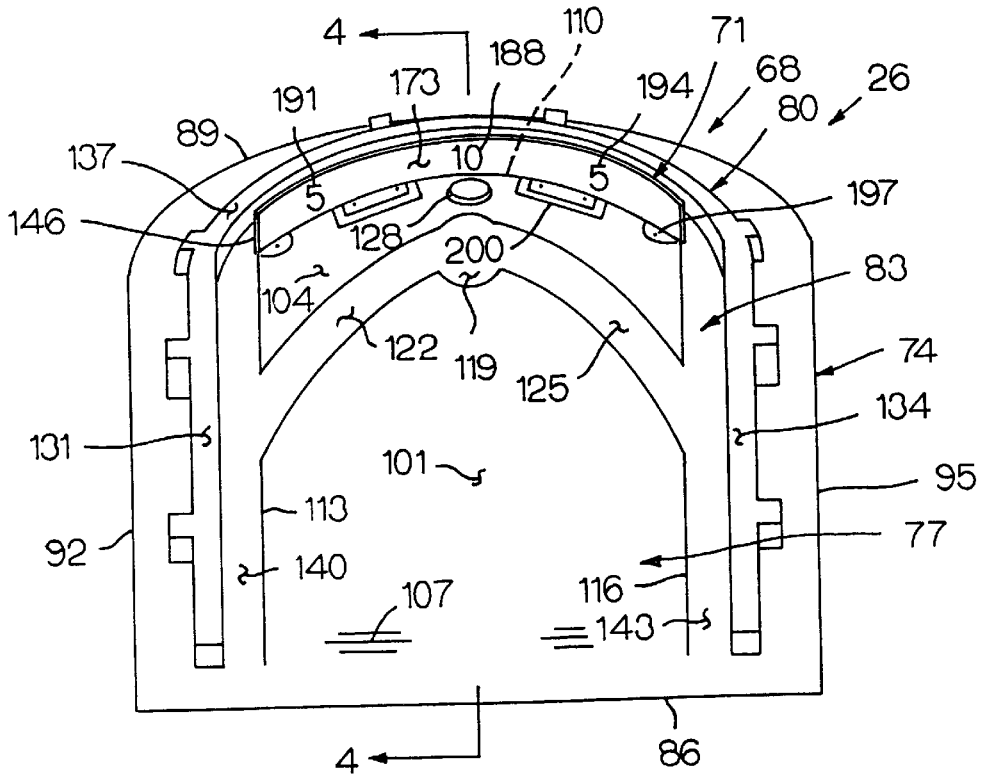
FIG. 2 is a top plan view of the inclined putting structure showing the relationship between the main target hole, the ball return channels, the peripheral wall, and the back wall.

Referring to FIGS. 2 and 3, putting structure 26 comprises a base structure 68 and an arcuate back wall 71. Base structure 68 comprises a floor-contacting base 74, an inclined central ramp 77, and an inclined U-shaped peripheral wall 80, with a U-shaped outer ball return channel 83 between ramp 77 and wall 80. Base 74 includes a straight front edge 86, and an arcuate rear edge 89, which connect respective side edges 92 and 95. Base 74 rests on a floor 98. Central ramp 77 includes an inclined front ball support surface 101, a level rear ball support surface 104, a front edge 107, an arcuate rear edge 110, and respective inclined straight left and right side edges 113 and 116.

A circular target hole recess 119 is centered on central ramp 77 adjacent rear edge 110, with respective laterally extending arcuate left and right ball return channels 122 and 125, and a logo or alignment plug 128 which extends vertically behind target hole recess 119. A medallion or other advertising logo (not shown) can be affixed to alignment plug 128. Peripheral wall 80 extends around central ramp 77 and includes respective inclined left and right wall portions 131 and 134 interconnected by an arcuate end wall portion 137, with inclined U-shaped outer ball return channel 83. Outer ball return channel 83 includes respective straight left and right side channels 140 and 143 connected by an arcuate rear channel 146, to a pair inner ball return channels 122 and 125.

Back wall 71 comprises an upstanding, arcuate wall 173. A main score indicia 188 and a pair of minor score indicia 191 and 194 comprise decals, stickers, or are painted, or otherwise applied to back wall 173. Back wall 71 is secured to support surface 104 at the rear edge 110 of ramp 77 by a plurality of rivets 197, adhesives, or other such securing means.

Putting mat 23 has the same width as central ramp 77 with greens portion 41 being removably connected to ramp 77 by mating pairs of hook fastener patches 200 and loop fastener patches (not shown). The hook fastener patches 200 are affixed to support surface 104 at rear edge 110. The loop fastener patches are affixed to backing sheet 32, positioned to mate with the respective hook fastener patches 200 when greens portion 41 is placed against support surface 104. In such a position, alignment plug 128 extends through alignment plug hole 65, main target hole 56 is positioned over target hole recess (depression) 119, and secondary target holes 59 and 62 are positioned over inner ball return channels 122 and 125.

Figure 4:
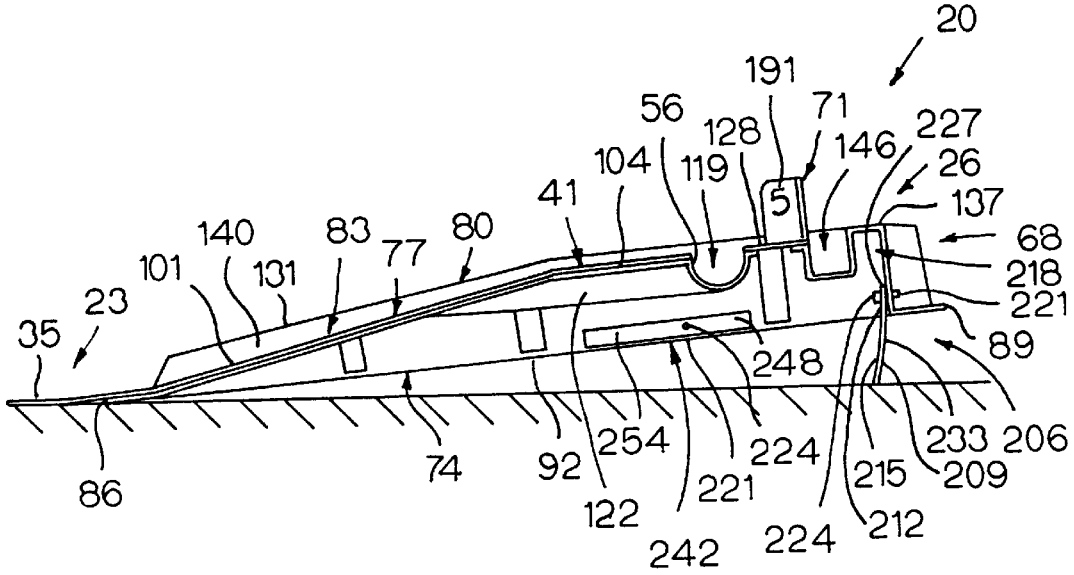
FIG. 4 is a longitudinal vertical sectional view taken on line 4—4 of FIG. 2, showing the putting structure at an inclined position with the incline arm deployed to increase putting difficulty, and further showing the relative heights of the target hole recess, the inner and outer ball return channels, and the back wall, in such a deployed position.

The angle of inclination of front ball support surface of ramp 77 is about 20° with rear ball support surface being level with floor 98. A variable incline mechanism 206 on putting structure 26 allows selective inclination an additional 100 from a lower position wherein base 74 rests on floor 98, to a maximum angle of inclination. Referring to FIGS. 3 and 4, an incline mechanism 206 comprises an incline arm 209 having respective upper and lower end portions 212 and 215. Upper end portion 212 is pivotally connected to end wall portion 137 within a recess 218 by a pivot bolt 221 and a locknut 224.

When incline arm 209 is in a horizontal, or stored position, base 74 contacts floor 98. When incline arm 209 is pivoted to a vertical, or deployed position with lower end portion 215 resting on floor 98, front edge 86 remains contacting floor 98 while rear edge 89 is supported above floor 98. If so desired, incline arm 209 can be pivoted at a more central location such that upper and lower end portions 212 and 215 are of differing distances from an alternate pivot hole 233.

Figure 5:
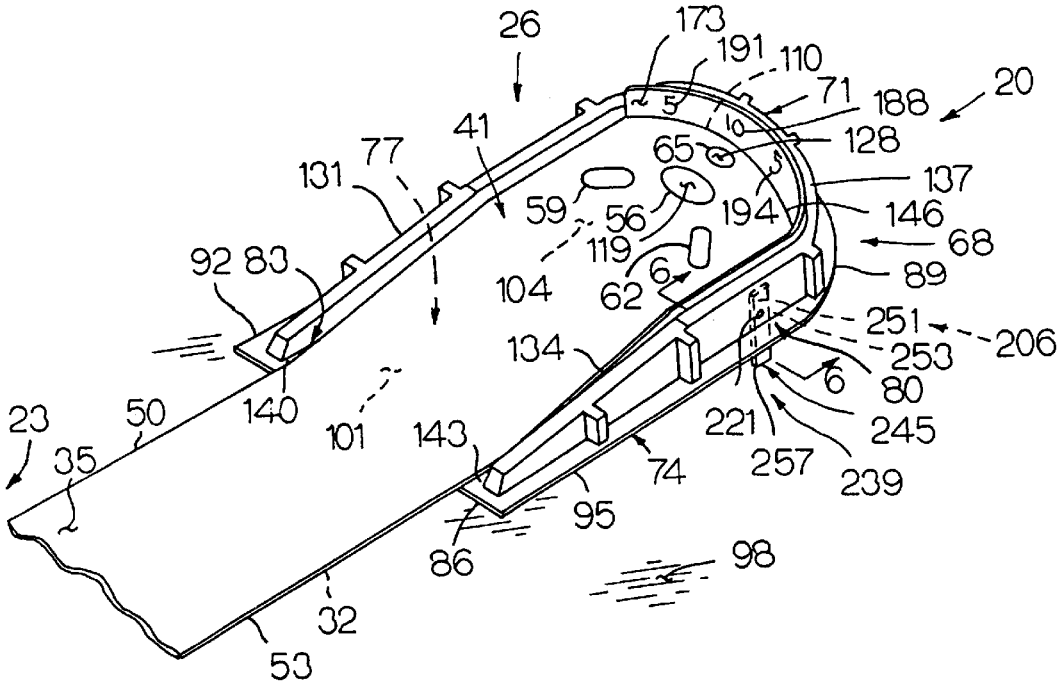
FIG. 5 is a fragmentary perspective view of the portable putting green showing the tilt arm of one tilt mechanism deployed to laterally tilt the putting structure for increased putting difficulty.
Figure 6:
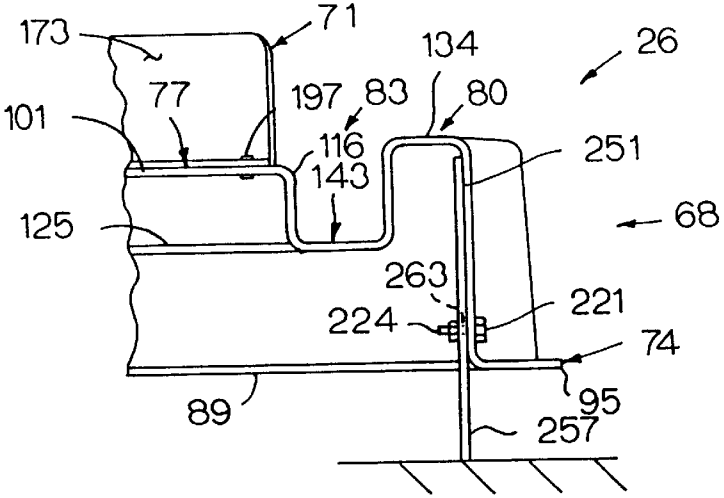
FIG. 6 is a fragmentary lateral, vertical sectional view taken on line 6—6 of FIG. 5, to an enlarged scale, showing the deployed position and the mounting of such tilt arm to the inclined base structure.
Figure 7:
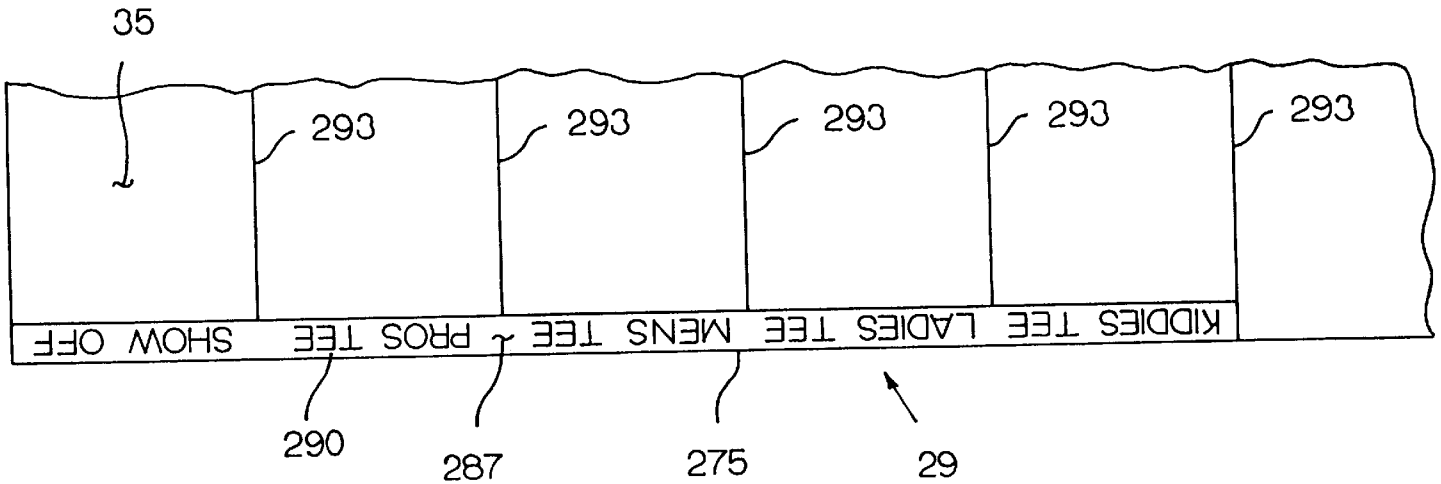
FIG. 7, is a fragmentary top plan view of the putting portion of the putting mat with the stance marker.

The angle of tilt of putting structure 26 can be changed by a variable lateral tilt mechanism 239. Referring to FIGS. 4 and 5, tilt mechanism 239 comprises a pair of left and right tilt arms 242 and 245, having respective upper end portions 248 and 251, and lower end portions 254 and 257. Upper end portions 248 and 251 are pivotally connected at pivot holes 260 and 263 to respective left and right side wall portions 131 and 134 of peripheral wall 80, by bolts 221 and locknuts 224.

When tilt arms 242 and 245 are in their respective horizontal, or stored positions, base 74 rests on floor 98. When either of tilt arms 242 and 245 is pivoted to its vertical position, the opposite left or right side edge 92 or 95 of base 74 rests on floor 98 while the other side edge adjacent the other vertical tilt arm is raised above floor 98. If so desired, either tilt arm can be pivoted at an end pivot hole (not shown) to provide only a single tilt angle in each lateral direction.

Stance marker 29 has a J-shaped cross-section, which enhances the side edge of the putting mat. Marker 29 includes an indicia 290 indicating varying distances such as "Kiddies Tee", "Ladies Tee", "Men's Tee", "Pros Tee", and "Show Off", with "Kiddies Tee" being the closest to main target hole 56, and "Show Off" being the furthest to increase the level of difficulty. Indicia 290 corresponds with a plurality of transverse lines 293 which extend laterally across putting surface 35 which are painted, sewn, or otherwise provided thereon.

Many variations of the putting green and method of use thereof are possible while staying within the same inventive concept. The incline and tilt mechanisms can be of other designs which provide similar functions, such as non-pivoting telescoping tube assemblies or telescoping rod and tube assemblies, which assemblies can be button-locked in predetermined positions or infinitely variably locked such as by using locking collars or set screws.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

Having described my invention, I claim:

1. A portable pulling green for practicing putting using a golf putter and a golf ball on a floor, comprising:

an elongate putting mat having an upper putting surface, a lower backing surface, respective opposite putting and greens portions, a pair of side edges, and having a main target hole through said greens portions to receive a golf ball;

an inclined putting structure which includes a base structure comprising a base, an inclined central ramp supported by said base on the floor, and an upstanding peripheral wall which extends around at least a portion of said central ramp to retain the golf ball on said rutting structure, said central ramp having an upper ball-supporting surface, a ball-receiving front edge, a rear edge, respective left and right side edges, with a target hole depression extending into said upper support surface, and a downwardly inclined, inner ball-return channel having an inlet portion extending from said target hole depression, and an outlet end portion adjacent one of said side edges of said central ramp at said front edge thereof;

wherein said lower backing surface of said putting mat at said greens portion is connectable to said ball support surface of said central ramp, with said main target hole thereof disposed over said target hole depression such that when the golf ball is placed on said putting portion of said putting mat and struck by a putter, the ball rolls into said main target hole and into said target hole depression, the ball rolls under the influence of gravity into said inlet portion of said inner ball-return channel and out through said outlet portion thereof adjacent one of said side edges of said putting mat with sufficient velocity and momentum to roll to a position adjacent said putting portion of said putting mat in preparation for a subsequent putt;

the inclined putting structure further comprising a variable incline mechanism connected to the base structure and supporting a rear portion of said base structure in a raised position relative to a front portion thereof to further incline the central ramp;

the variable incline mechanism comprising an incline arm having respective opposite, first and second end portions and being pivotally connected to the base structure such that the opposite end portions are of differing distances from the pivotal connection, to support the rear portion of the base at an alternate height above a supporting surface, such that when said first end portion is in contact with the supporting surface the base structure is disposed at a first height, and by pivoting the incline arm 180°, the base structure is disposed at a second height;

a back wall being connected to the central ramp adjacent the rear edge thereof in front of a rear portion of an outer ball-return channel to prevent a golf ball from rolling off said rear edge into said outer channel; and the peripheral wall extending completely around the sides and rear of the central ramp, and the inclined outer ball-return channel being disposed between the central ramp and said peripheral wall along the length thereof, which receives golf balls from the inlet portion of the inner ball-return channel, with the outlet end portion thereof comprising a lower portion of said outer ball-return channel.

2. A portable putting green according to claim 1, wherein said central ramp includes a level rear portion at the main target hole.

3. A portable putting green according to claim 1, wherein the putting mat includes a secondary target hole through the greens portion thereof to receive and return the golf ball to a position adjacent the putting portion of said putting mat.

4. A portable putting green according to claim 3, further comprising said back wall having indicia indicating the scoring value for the main and the secondary target holes.

5. A portable putting green according to claim 3, wherein the secondary target hole is disposed such that a golf ball which passes therethrough enters the inner ball return channel.

6. A portable putting green according to claim 3, wherein the putting mat includes an additional secondary target hole through the greens portion thereof to receive the golf ball, said secondary target hole also having a different configuration than the main target hole, the central ramp includes a second inner ball return channel which extends from the target hole depression in a laterally opposite direction from the first inner ball return channel, which secondary target hole returns a golf ball to a position adjacent the putting portion of said putting mat.

7. A portable putting green according to claim 6, further comprising said back wall having indicia indicating the scoring value for the main and the secondary target holes.

8. A portable putting green according to claim 1, wherein the inclined putting structure further comprises a variable lateral tilt mechanism connected to the base structure wherein said lateral tilt mechanism alternately supports respective side portions of said base structure in respective raised positions relative to the opposite respective side portion thereof so as to provide respective opposite tilted positions of the central ramp.

9. A portable putting green according to claim 8, including a pair of variable lateral tilt mechanisms connected to respective side portions of the base structure.

10. A portable putting green for practicing putting using a golf putter and a golf ball on a floor, comprising:

an elongate putting mat having an upper putting surface, a lower backing surface, respective opposite putting and greens portions, a pair of side edges, and having a main target hole and a secondary target hole through said greens portions to receive a golf ball;

an inclined putting structure which includes a base structure comprising a base, an inclined central ramp supported by said base on the floor, and an upstanding peripheral wall which extends around at least a portion of said central ramp to retain the golf ball on said putting structure, said central ramp having an upper ball-supporting surface, a ball-receiving front edge, a rear edge, respective left and right side edges, with a target hole depression extending into said upper support surface and a downwardly inclined, inner ball-return channel having an inlet portion extending from said target hole depression and an outlet end portion adjacent one of said side edges of said central ramp at said front edge thereof;

wherein said lower backing surface of said putting mat at said greens portion is connectable to said ball support surface of said central ramp, with said main target hole thereof disposed over said target hole depression such that when the golf ball is placed on said putting portion of said putting mat and struck by a putter, the ball rolls into said main target hole and into said target hole depression, the ball rolls under the influence of gravity into said inlet portion of said inner ball-return channel and out through said outlet portion thereof adjacent one of said side edges of said putting mat with sufficient velocity and momentum to roll to a position adjacent said putting portion of said putting mat in preparation for a subsequent putt;

the inclined putting structure further comprising a variable incline mechanism connected to the base structure and supporting a rear portion of said base structure in a raised position relative to a front portion thereof to further incline the central ramp;

the variable incline mechanism comprising an incline arm having respective opposite, first and second end portions and being pivotally connected to the base structure such that the opposite end portions are of differing distances from the pivotal connection, to support the rear portion of the base at an alternate height above a supporting surface, such that when said first end portion is in contact with the supporting surface the base structure is disposed at a first height, and by pivoting the incline arm 180°, the base structure is disposed at a second height;

a back wall being connected to the central ramp adjacent the rear edge thereof in front of a rear portion of an outer ball-return channel to prevent a golf ball from rolling off said rear edge into said outer channel, said back wall having indicia indicating the scoring value for the main and the secondary target holes; and the secondary target hole extending through the greens portion thereof to receive and return the golf ball to a position adjacent the putting portion of said putting mat.

11. A portable putting green for practicing putting using a golf putter and a golf ball on a floor, comprising:

an elongate putting mat having an upper putting surface, a lower backing surface, respective opposite putting and greens portions, a pair of side edges, and having a main target hole and a secondary target hole through said greens portions to receive a golf ball;

an inclined putting structure which includes a base structure comprising a base, an inclined central ramp supported by said base on the floor, and an upstanding peripheral wall which extends around at least a portion of said central ramp to retain the golf ball on said putting structure, said central ramp having an upper ball-supporting surface, a ball-receiving front edge, a rear edge, respective left and right side edges, with a target hole depression extending into said upper support surface, a downwardly inclined, first inner ball-return channel having an inlet portion extending from said target hole depression and an outlet end portion adjacent one of said side edges of said central ramp at said front edge thereof, and an outer ball-return channel;

wherein said lower backing surface of said putting mat at said greens portion is connectable to said ball support surface of said central ramp, with said main target hole thereof disposed over said target hole depression such that when the golf ball is placed on said putting portion of said putting mat and struck by a putter, the ball rolls into said main target hole and into said target hole depression;

the ball rolls under the influence of gravity into said inlet portion of said first inner ball-return channel and out through said outlet portion thereof adjacent one of said side edges of said putting mat with sufficient velocity and momentum to roll to a position adjacent said putting portion of said putting mat in preparation for a subsequent putt;

the inclined putting structure further comprising a variable incline mechanism connected to the base structure and supporting a rear portion of said base structure in a raised position relative to a front portion thereof to further incline the central ramp;

the variable incline mechanism comprising an incline arm having respective opposite, first and second end portions and being pivotally connected to the base structure such that the opposite end portions are of differing distances from the pivotal connection, to support the rear portion of the base at an alternate height above a supporting surface such that when said first end portion is in contact with the supporting surface, the base structure is disposed at a first height, and by pivoting the incline arm 180°, the base structure is disposed at a second height;

a back wall being connected to the central ramp adjacent the rear edge thereof in front of a rear portion of the outer ball-return channel to prevent a golf ball from rolling off said rear edge into said outer ball-return channel, said back wall having indicia indicating the scoring value for the main and the secondary target holes; and the putting mat including an additional secondary target hole through the greens portion thereof to receive the golf ball, said additional secondary target hole also having a different configuration than the main target hole, the central ramp including a second inner ball-return channel which extends from the target hole depression in a laterally opposite direction from the first inner ball-return channel, which secondary target hole returns a golf ball to a position adjacent the putting portion of said putting mat.

12. A portable putting green according to claim 11, wherein the inclined putting structure further comprises a variable lateral tilt mechanism connected to the base structure for supporting respective side portions of said base structure in respective raised positions to provide opposite tilted positions of the central ramp.

13. A portable green according to claim 11, wherein the variable incline mechanism comprises said incline arm having respective upper and lower end portions, being pivotally connected to the rear portion of the base structure such that said incline arm has a horizontal stored position wherein the base of said base structure is directly supported by the floor, and a vertical deployed position with said lower end portion of said incline arm resting on the floor supporting the rear portion of said base structure off the floor, and comprising variable lateral tilt mechanisms which each comprise a respective tilt arm having respective upper and lower end portions, being pivotally connected to a respective side portion of the base structure such that each of said tilt arms has a horizontal stored position wherein the respective side portion of said base is directly supported by the floor, and a vertical deployed position with said lower end portion of the respective tilt arm resting on the floor supporting the respective side portion of said base structure off the floor, with the opposite tilt arm being in the stored position with the respective side portion being directly supported by the floor.

14. A portable putting green for practicing putting using a golf putter and a golf ball on a floor, comprising:

an elongate putting mat having an upper putting surface, a lower backing surface, respective opposite putting and greens portions, a pair of side edges, and having a main target hole through said greens portions to receive a golf ball;

an inclined putting structure which includes a base structure comprising a base, an inclined central ramp supported by said base on the floor, and an upstanding peripheral wall which extends around at least a portion of said central ramp to retain the golf ball on said putting structure, said central ramp having an upper ball-supporting surface, a ball-receiving front edge, a rear edge, respective left and right side edges, with a target hole depression extending into said upper support surface and a downwardly inclined, inner ball-return channel having an inlet portion extending from said target hole depression and an outlet end portion adjacent one of said side edges of said central ramp at said front edge thereof; and wherein said lower backing surface of said putting mat at said greens portion is connectable to said ball support surface of said central ramp, with said main target hole thereof disposed over said target hole depression such that when the golf ball is placed on said putting portion of said putting mat and struck by a putter, the ball rolls into said main target hole and into said target hole depression;

the ball rolls under the influence of gravity into said inlet portion of said ball-return channel and out through said outlet portion thereof adjacent one of said side edges of said putting mat with sufficient velocity and momentum to roll to a position adjacent said putting portion of said putting mat in preparation for a subsequent putt;

the inclined putting structure further comprising a variable incline mechanism connected to the base structure and supporting a rear portion of said base structure in a raised position relative to a front portion thereof to further incline the central ramp;

the variable incline mechanism comprising an incline arm having respective opposite, first and second end portions and being pivotally connected to the base structure such that the opposite end portions are of differing distance from the pivotal connection, to support the rear portion of the base at an alternate height above a supporting surface such that when said first end portion is in contact with the supporting surface, the base structure is disposed at a first height, and by pivoting the incline arm 180°, the base structure is disposed at a second height; and the variable incline mechanism comprising an incline arm having respective upper and lower end portions, with the upper end portion being pivotally connected to the rear portion of the base structure, such that said incline arm has a horizontal stored position wherein the base of said base structure is directly supported by the floor, and a vertical deployed position with said lower end portion of said incline arm resting on the floor supporting the rear portion of said base structure off the floor, with the front portion thereof being directly supported by the floor.

* * * * *

UNITED STATES PATENT AND TRADEMARK OFFICE

CERTIFICATE OF CORRECTION

PATENT NO. : 6,569,027 B2
DATED : May 27, 2003
INVENTOR(S) : Raymond J. Florian

It is certified that error appears in the above-identified patent and that said Letters Patent is hereby corrected as shown below:

Column 3,
Line 52, change “100” to -- 10° --

Column 4,
Line 47, change “pulling” to -- putting --
Line 59, change “rutting” to -- putting --

Signed and Sealed this

Eighteenth Day of May, 2004

JON W. DUDAS
*Acting Director of the United States Patent and Trademark Office*